US005445317A

United States Patent [19]

Sokolowski

[11] Patent Number: 5,445,317

[45] Date of Patent: Aug. 29, 1995

[54] MAILBOX FLAG STRUCTURE

[76] Inventor: Dennis W. Sokolowski, 294 Forest Dr., Crystal Lake, Ill. 60014

[21] Appl. No.: 206,017

[22] Filed: Mar. 4, 1994

[51] Int. Cl.[6] ..... B65D 91/00

[52] U.S. Cl. ..... 232/34

[58] Field of Search ..... 232/17, 34, 35

[56] References Cited

U.S. PATENT DOCUMENTS

| | | | |
|---|---|---|---|
| 910,355 | 1/1909 | Cannady . | |
| 2,553,164 | 5/1951 | Bishop . | |
| 3,275,227 | 9/1966 | Bogue | 232/34 |
| 3,325,092 | 6/1967 | Hoffman | 232/35 |
| 3,596,631 | 8/1971 | Sutton . | |
| 3,827,627 | 8/1974 | Clement | 232/35 |
| 4,697,733 | 10/1987 | Todd | 232/17 |
| 4,875,431 | 10/1989 | Dobosz . | |
| 4,960,067 | 10/1990 | Currie . | |

*Primary Examiner*—Flemming Saether
*Attorney, Agent, or Firm*—Charles F. Meroni, Jr.

[57] ABSTRACT

This invention concerns a combination mailbox structure including a mailbox, a rotatable flag a pivot pivotally mounting the flag on one side of the mailbox, and including an upwardly facing ledge, a decorative device attached to a mailbox flag, the decorative device being movable on a mailbox from a "down" position to an "up" position comprising a mail signaling figurine, the mail signaling figurine having an upright decorated front side and a back side, the mail signaling figurine having means attached to its backside for attaching and securing the mail signaling figurine to a mailbox flag and to maintain its attachment to the mailbox flag as it is manually moved back and forth on the pivot from a "down" position to an "up" position.

7 Claims, 2 Drawing Sheets

MAILBOX FLAG STRUCTURE

BACKGROUND OF THE INVENTION

According to my invention, I have provided a new and improved mailbox decoration or decorative device which is in the form of a mail signaling figurine for mounted attachment to a mailbox flag. The mailbox flag on a customary rural type mailbox is rotatable 90 degrees from the horizontal position to an upright position. A stop is provided as an aid to hold the flag in an upright position.

According to further features of my invention, I have provide my decorative device or mail signaling figurine with means for attaching the mail signaling figurine to a mailbox flag so that the figurine can rotate 90 degrees with the flag together as the flag is moved back and forth for use in a customary manner. When the flag is in an upright position, the mail signaling figurine is oriented in an upright position and serves to provide an enlarged signal which according to my invention is in the form of a holiday decoration on the mailbox structure.

In the past, there has been at least one prior device that has been mounted on a mailbox for decorative purposes. Also, there have been different types of flags for use on mailboxes and in this connection, attention is directed to U.S. Pat. No. 2,553,164. One of the decorative devices that has been utilized for mounting on a mailbox is shown in U.S. Pat. No. 3,596,631 where the patentee describes his signal device as shown and illustrated at 21 and 22 in the patent drawings.

One important advantage or my mail signaling device or decorative device on rural mailboxes is to provide a signal that can be seen for greater distances so that manual movement of the flag and the mail signaling device or decorative device will serve to notify the mail carrier as well as the owner that the box contains mail that needs to be picked up either by the mail carrier or the mailbox owner.

According to my invention, the signaling device that I have developed is for a mailbox and in particular for a standard U.S. mailbox typically used in rural areas, which signaling device indicates to a distant observer whether or not the mailbox has been opened. An important object of this invention is to provide a new and improved mail signaling device which not only serves to provide a signal for the mail carrier and the owner, but also serves to decorate the mailbox in an attractive way appropriate to the season of the year.

Still another object of this invention relates to a new and improved signal device for a mailbox which is simple in construction and operation. A further object of this invention is to provide a new and improved signal device in the form of a decorative figurine which will indicated to a distant observer when a mailbox needs to be serviced either by picking up mail to be removed by the mail carrier or mail to be removed by the mailbox owner.

SUMMARY OF THE INVENTION

According to my present invention I have provided a combination mailbox structure including a mailbox, a rotatable flag, a pivot pivotally mounting the flag on one side of the mailbox, and including an upwardly facing ledge, a decorative device attached to a mailbox flag, the decorative device being movable on a mailbox from a "down" to an "up" position comprising a mail signaling figurine, the mail signaling figurine having an upright decorated front side and a back side, the mail signaling figurine having means attached to its backside for attaching and securing the mail signaling figurine to a mailbox flag and to maintain its attachment to the mailbox flag as it is manually moved back and forth on the pivot from a "down" position to an "up" position.

Another feature of my invention concerns the use of the combination of my invention wherein the mail signaling figurine has a bottom edge supported by the upwardly facing ledge adjacent to the pivot when the mail signaling figurine and the flag are in an upright position.

Still another feature of my invention relates to a combination which comprises a pair of side-by-side pegs positioned between the upper and lower ends of the mail signaling figurine, means securing the pegs to the backside of the mail signaling figurine, retaining grooves provided on the pegs and being positioned adjacent outer ends of the pegs, and a rubber band secured at opposite ends in said grooves of the pegs in retained assembly, the rubber band, the pegs, and the backside of the mail signaling figurine defining a flag stem retaining enclosure with the flag stem being lodged in the flag stem retaining enclosure securing the flag stem with the mail signaling figurine.

According to important features of my invention, I have provided a new and improved combination, the combination comprising a mailbox, a rotatable flag, a pivot pivotally mounting the flag on one side of the mailbox, and including an upwardly facing ledge, the improvement of a decorative device attached to a mailbox flag, the decorative device being movable on a mailbox from a "down" to an "up" position comprising a mail signaling figurine, the mail signaling figurine having an upright decorated from side and a back side, the mail signaling figurine having means attached to its backside for attaching and securing the mail signaling figurine to a mailbox flag and to maintain its attachment to the mailbox flag as it is manually moved back and forth on the pivot from a "down" position to an "up" position.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
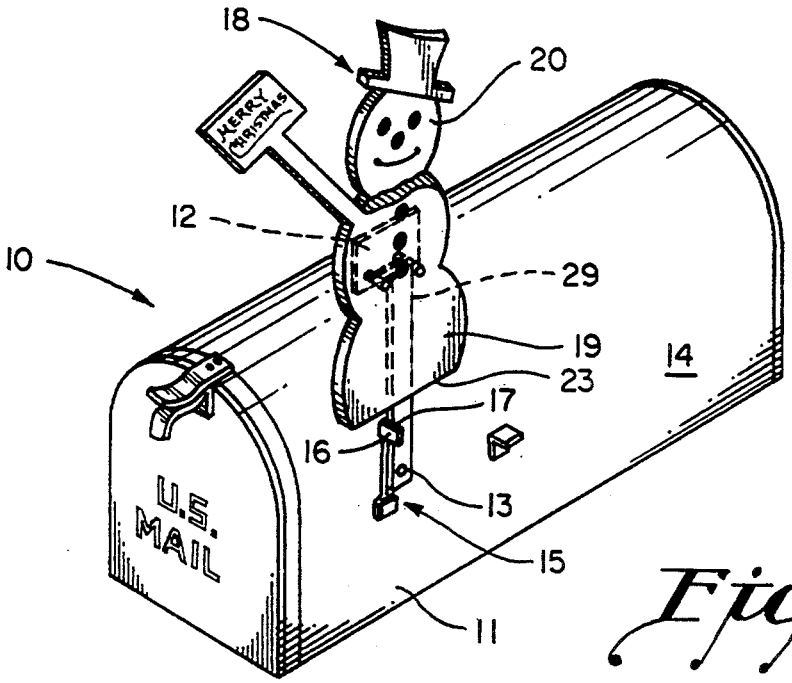
FIG. 1 is a prospective view of my mailbox structure having my decorative device mounted thereon which embodies important features of my invention.

The reference numeral 10 indicates generally a mailbox structure. The mailbox structure 10 includes a mailbox 11 which is of a conventional type. The mailbox 11 has a rotatable mailbox flag 12 and a pivot structure 13 which pivotally mounts the rotatable flag 12 on one side 14 of the mailbox 11 in a conventional way. The mailbox 11 includes structure 15 for securing the rotatable flag 12 in an upright position to the one side 14 of the mailbox. The structure 15 includes a stop 16 having an upwardly facing ledge 17.

According to my invention, I have provided a new and improved mail signaling device or decorative device 18 which is attached to the mailbox flag 12. The mail signaling device or decorative device 18 may be comprised of any suitable material such as a cut-out made from wood or from a suitable synthetic plastic. The mail signaling device or decorative device 18 is pivoted on the pivot 13 and movable relative to the side 14 of the mailbox 11 from a "down" to an "up" position and vice-versa. The mail signaling device or decorative device 18 includes a mail signaling figurine 19 which has an attractive shape that can be cut out into a shape appropriate to a given season or event as may be desired. The mail signaling figurine 19 has an upright decorated front side 20 and a back side 21. The mail signaling figurine has a structure 22 on its backside for attaching and securing the mail signaling figurine 19 to the mailbox flag or rotatable flag 12 to ensure its attachment to the mailbox flag as it is manually moved back and forth on the pivot 13 from a "down" position to an "up" position.

Figure 1A:
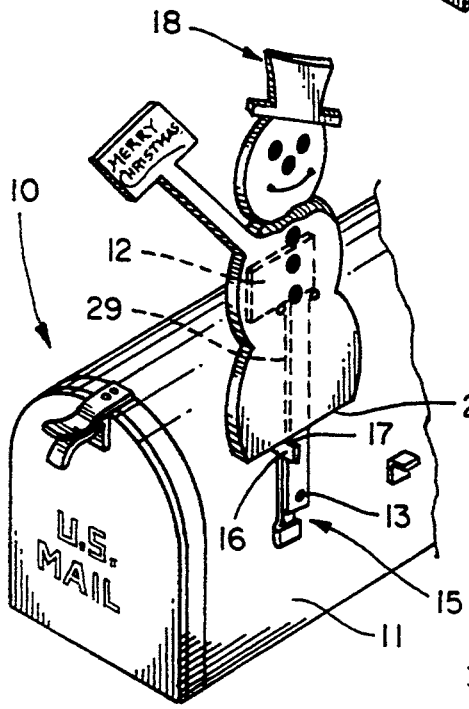
FIG. 1A is an enlarged fragmentary view of a modification illustrating a mail signaling figurine supported on a ledge on a flag stop.

The mail signaling figurine 19 is provided with a bottom edge 23 that is supported in one embodiment by the upwardly facing ledge 17 as shown in FIG. 1A when the mail signaling figurine 19 and the flag 12 are in an upright position.

Figure 2:
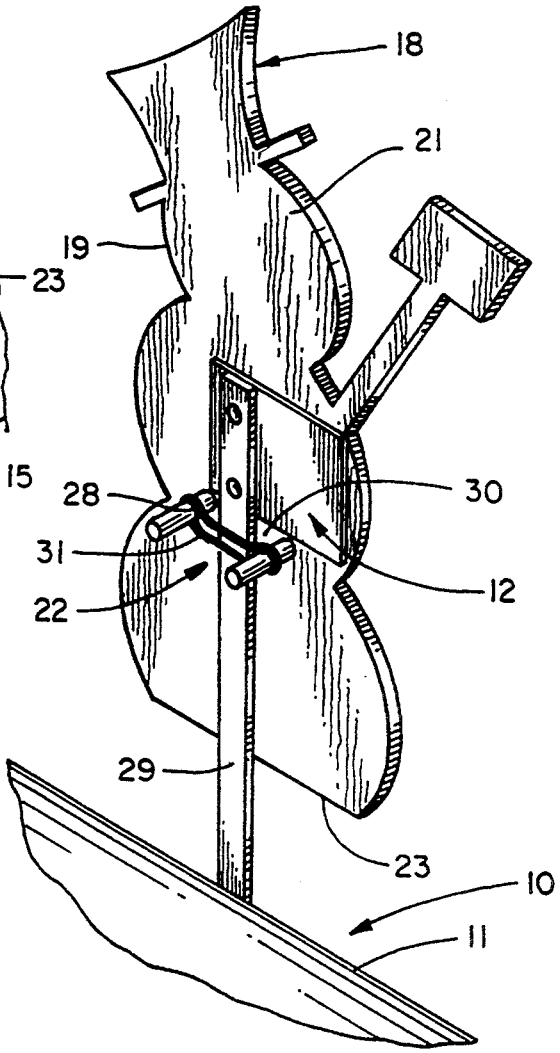
FIG. 2 is an enlarged fragmentary back view of the decorative device illustrating how it can be secured to a flag stem.

The structure 22 which functions to attach the mail signaling figurine 19 to the rotatable mailbox flag 12 comprises a pair of side-by-side pegs 25-25. The pegs are positioned between upper and lower ends 26 and 27 of the mail signaling figurine 19. The peg holes 24, 24 are located between the upper and lower ends of the mail signaling figurine for receipt of ends of the pegs 25-25 to secure the pegs to the backside 21 of the mail signaling figurine 19. Retaining grooves 28, 28 are provided on the pegs 25-25 which are positioned adjacent outer ends of the pegs a sufficient distance to allow a flag stem 29 to be received in a flag stem retaining enclosure 30. The rubber band 31, the pegs 25-25 and the back side 21 of the mail signaling figurine define the flag stem retaining enclosure 30 (FIG. 2). The flag stem 29 is lodged in the flag stem retaining enclosure 30 and maintain within the enclosure by means of the rubber band 31 being secured in the retaining grooves 28, 28 provided on the pegs 26-26. To remove the mail signaling figurine 19 from the rotatable flag 12, the rubber band 31 is disengaged from the retaining grooves 28, 28 and detached from the pegs 26-26. Another figurine can be mounted with its back side against the flag with the flag stem 29 located into the enclosure 30 and the rubber band 30 can be secured into the grooves 28-28 to trap the flag stem in secured assembly with figurine 19.

Excellent results can be obtained in the manufacture of my mail signaling figurine 19 by utilizing ¼ inch plywood in various shapes as identified below. The plywood is provided with two peg holes 24, 24 which are used to hold the two ¼ inch dowel rods or pegs 25-25. These dowel rods can be 1 inch long. The two dowel rods fit around the flag on the mailbox, approximately 3 inches from the bottom of the flag. The mail signaling figurine is secured to the flag with the rubber band 31. It is further contemplated that the mail signaling figurine may have a battery operated light attached to it for added decoration.

It is contemplated further that the mail signaling figurine may have an appropriate shape to commemorate Valentine's Day, Easter, Memorial Day, Fourth of July, Labor Day, Halloween, Thanksgiving and Christmas. A number of different types of mail signaling figurines can be configured including the following: Valentine heart, Cupid and heart, Easter bunnies, Easter eggs, Easter basket, Easter flowers, American flags, ghosts, pumpkins, witches, skeletons, turkey, pilgrims, Christmas trees, snowman, candy canes, reindeer, Santa's and elves.

Figure 3:
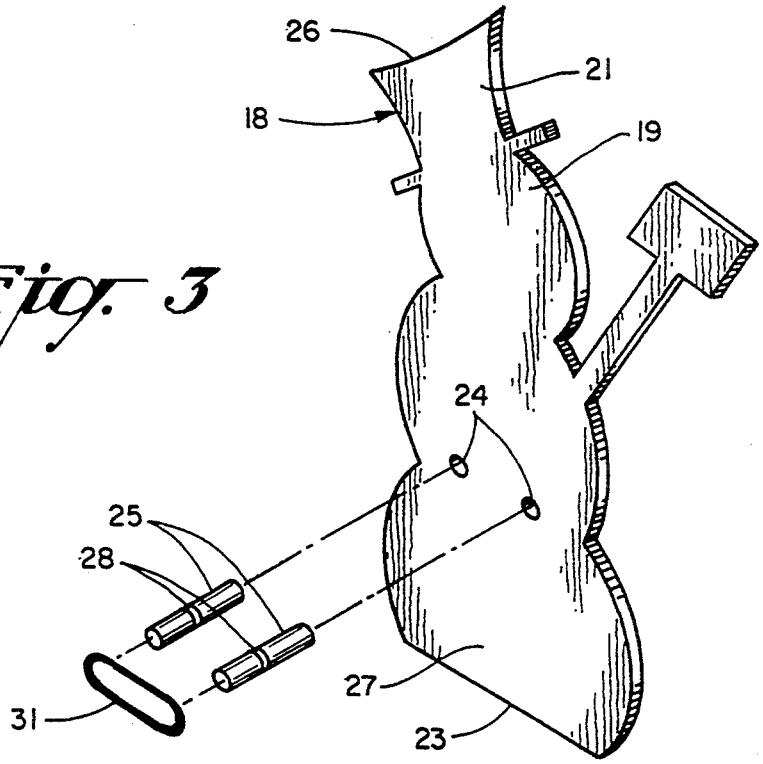
FIG. 3 is an exploded view of the mail signaling figurine shown in FIG. 2.
Figure 4:
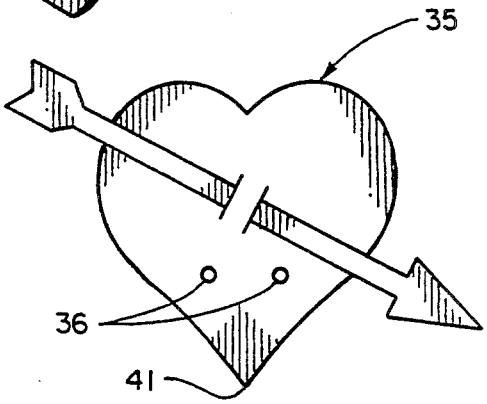
FIG. 4 is an enlarged front view of a modified type of a mail signaling figurine having pegs as shown in FIG. 3.

In FIG. 4 I have shown a modified type of heart shaped figurine 35. This figurine has a pair of peg holes 36 that are adapted be secured with pegs 25 as shown in FIG. 3 for securing the figurine 35 to mailbox flag 12 in the same way as previously described.

Figure 5:
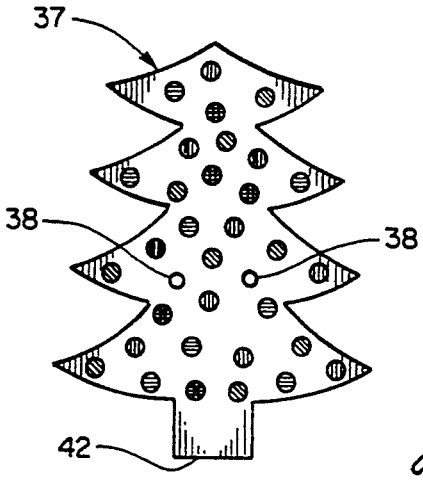
FIG. 5 is yet another front view of a modified type of a mail signaling figurine again having pegs for attaching the mail signaling figurine to a mailbox flag.

In FIG. 5 is shown still another figurine 37 that is in the shape of a Christmas tree. This figurine has a pair of peg holes 38-38 which are adapted to be secured with pegs 25 as shown in FIG. 3. The figurine 37 is adapted to be assembled with the rotatable mailbox flag 12 in the same way as previously described.

Figure 6:
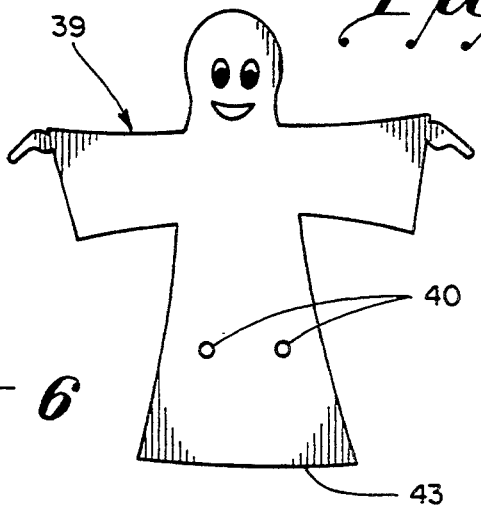
FIG. 6 is a front elevation of yet another differently shaped mail signaling figurine having pegs for attaching it to a mailbox flag.

In FIG. 6 is shown still another type of figurine 39 in the form of a smiling ghost which has a pair of peg holes 40-40 that are also adapted to be secured with pegs and secured to a mailbox flag 12 as previously described.

The figurines 35, 37 and 39 all have bottom surfaces indicated at 41, 42 and 43 that serve as ledges or points for engagement with the mailbox stop ledge 17 in the same way as previously described and illustrated in FIG. 1A.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A decorative device for attachment to a mailbox flag with a flag stem movable on a mailbox from a down position to an up position comprising a mail signaling figurine having a decorated front side and a back side, the mail signaling figurine having means attached to its backside for attaching and securing the mail signaling figurine to the mailbox flag and to maintain its attachment to the mailbox flag as the mailbox flag is manually moved back and forth from the down position to the up position, said means comprises a pair of side-by-side pegs positioned between upper and lower ends of the mail signaling figurine, means securing the pegs to the backside of the mail signaling figurine, retaining grooves provided on said pegs and being positioned adjacent outer ends thereof, and a retaining means secured in said grooves of said pegs in a retained assembly, the retaining means, the pegs, and the backside of said mail signaling figurine defining a flag stem retaining enclosure for receiving the flag stem to secure the mail signaling figurine to the mailbox flag.

2. The decorative device of claim 1 wherein the retaining means is a rubber band.

3. In a mailbox structure including a mailbox, a rotatable mailbox flag with a flag stem, a pivot pivotally mounting the flag on one side of the mailbox, a decorative mail signaling device attached to the mailbox flag, comprising a mail signaling figurine, the mail signaling figurine having a decorated front side and a back side, the mail signaling figurine having means attached to its backside for attaching and securing the mail signaling figurine to the mailbox flag and to maintain its attachment as the mailbox flag is manually pivoted from a down position to a up position, said means comprises a pair of side-by-side pegs positioned between upper and lower ends of the mail signaling figurine, means securing the pegs to the backside of the mail signaling figurine, retaining grooves provided on said pegs and being positioned adjacent outer ends thereof, and a rubber band secured in said grooves of the pegs in a retained assembly, the rubber band, the pegs, and the backside of said mail signaling figurine defining a flag stem retaining enclosure with the flag stem being lodged in the flag stem retaining enclosure.

4. In combination, a mailbox structure including a mailbox, a rotatable mailbox flag with a flag stem, a pivot pivotally mounting the flag on one side of the mailbox, and including an upwardly facing ledge, a decorative device attached to the mailbox flag, comprising a mail signaling figurine, the mail signaling figurine having a decorated front side and a back side, the mail signaling figurine having means attached to its backside for attaching and securing the mail signaling figurine to the mailbox flag and to maintain its attachment as the mailbox flag is manually pivoted from a down position to a up position, said means comprises a pair of side-by-side pegs positioned between upper and lower ends of the mail signaling figurine, means securing the pegs to the backside of the mail signaling figurine, retaining grooves provided on said pegs and being positioned adjacent outer ends of thereof, and a rubber band secured in said grooves of said pegs in a retained assembly, the rubber band, the pegs, and the backside of said mail signaling figurine defining a flag stem retaining enclosure with the flag stem being lodged in the flag stem retaining enclosure.

5. The combination of claim 1 wherein the mail signaling figurine has a bottom edge supported by the upwardly facing ledge when the mail signaling figurine and the flag are in the up position.

6. In a mailbox structure including a mailbox, a rotatable mailbox flag, a pivot pivotally mounting the flag on one side of the mailbox, and including an upwardly facing ledge, a decorative mail signaling device attached to the mailbox flag, comprising a mail signaling figurine, the mail signaling figurine having a decorated front side and a back side, the mail signaling figurine having means attached to its backside for attaching and securing the mail signaling figurine to the mailbox flag and to maintain its attachment as the mailbox flag is manually pivoted from a down position to a up position, the mail signaling figurine has a bottom edge supported by the upwardly facing ledge when the mail signaling figurine and the mailbox flag are in the up position.

7. In combination, a mailbox structure including a mailbox, a rotatable mailbox flag, a pivot pivotally mounting the flag on one side of the mailbox, and including an upwardly facing ledge, a decorative device attached to the mailbox flag, comprising a mail signaling figurine, the mail signaling figurine having a decorated front side and a back side, the mail signaling figurine having means attached to its backside for attaching and securing the mail signaling figurine to the mailbox flag and to maintain its attachment a the mailbox flag is manually pivoted from a down position to a up position, the mail signaling figurine has a bottom edge supported by the upwardly facing ledge when the mail signaling figurine and the flag are in the up position.

* * * * *